United States Patent [19]

Hartmann

[11] Patent Number: 5,005,268

[45] Date of Patent: Apr. 9, 1991

[54] WATCH BAND OR BRACELET CLOSURE

[76] Inventor: György Hartmann, östra Förstads Gatan 7A, 21131 Malmö , Sweden

[21] Appl. No.: 448,524

[22] Filed: Dec. 11, 1989

[51] Int. Cl.[5] ..... A44B 11/25

[52] U.S. Cl. ..... 24/652; 24/265 WS; 24/658; 24/684; 24/701

[58] Field of Search ..... 24/265 WS, 652, 653, 24/656, 658, 684, 701

[56] References Cited

U.S. PATENT DOCUMENTS

| | | | |
|---|---|---|---|
| 244,475 | 7/1881 | Orcutt | 24/656 |
| 1,600,769 | 9/1926 | Marsh | 24/701 X |
| 2,853,759 | 9/1958 | Elsner | 24/656 |
| 3,908,243 | 9/1975 | Lou et al. | 24/653 |
| 4,675,955 | 6/1987 | Nakamura | 24/656 |

FOREIGN PATENT DOCUMENTS

| | | | |
|---|---|---|---|
| 1391922 | 2/1965 | France | 24/701 |
| 86598 | 1/1966 | France | 24/653 |
| 18009 | of 1910 | United Kingdom | 24/656 |

*Primary Examiner*—James R. Brittain
*Attorney, Agent, or Firm*—Donald A. Bergquist

[57] ABSTRACT

A novel closure or buckle for a band as might be used as a watchband, a bracelet, a necklace, or like article is disclosed. The closure requires no springs, biasing devices, nor snugly fitting members to remain closed. The closure employs a keyhole-type slot to receive a linking member and features a slide element engaged by the linking member within the keyhole slot, which slide element follows the inserted linking member as it slides into the narrow end of the slot thereby blocking the larger end of the slot to provide a smooth appearance to the closure in its latched position.

6 Claims, 2 Drawing Sheets

WATCH BAND OR BRACELET CLOSURE

BACKGROUND OF THE INVENTION

The present invention relates generally to clasps for ornamental items, such as watch bands, bracelets, necklaces and like articles, and pertains more specifically to a clasp wherein no springs, biasing means, nor snugly fitting members are employed.

Generally, this invention may be used with a mesh band or, alternatively, a band made of multiple links joined on pivot axes that are substantially parallel to the width of the band, thereby providing flexibility to allow the band to wrap around the wrist of the wearer and also providing adjustability by the adding or the removing of links.

Many clasps for ornamenntal items relay on spring tension or compression or on the compressive elasticity of elements that fit snugly together either to retain the principal latch mechanism or to retain a cosmetic cover that hides the workings of the latch mechanism. With time and repeated use, many such clasps fail because of wear or permanent deformation of the spring means. Although some clasps continue to function, they may become a nuisance because of the failure of the cosmetic cover to stay in place owing to wear or permanent deformation of their retaining means.

SUMMARY OF THE INVENTION

Accordingly, it is an object of this invention to provide a clasp for a watch band or the like wherein no springs, biasing means, nor compressive elasticity of its parts are required.

It is a further object of this invention to provide such a clasp that is especially easy to latch and unlatch, even by wearers who have impaired or reduced manual dexterity.

It is a further object of this invention to provide such a clasp wherein means are provided to create a smooth, finished, and attractive appearance to the clasp when latched.

DISCUSSION OF PRIOR ART

Clasps for ornamental items to be worn on the person have been the subject of much development throughout the many years over which people have decorated themselves with bracelets, necklaces, and like articles, including wrist watches, which are a recent and more utilitarian (though often quite ornamental) development relative to the other, largely ornamental, items described. The search for a clasp that at once is easy to open and close selectively, yet will not open inadvertently, has led to a wide variety of clasp arrangement providing various advantages and disadvantages. In addition, clasps for ornamental items should not detract from the aesthetic nature of the article in connection with which the clasp is utilized, a requirement that often calls for a compact, unobstructive device, without unslightly appendages or voids. The clasp should also be capable of being constructed of a variety of materials including precious or semi-precious materials with acceptable economy of time and materials.

A contribution to this technology was presented in U.S. Pat. No. 4,539,736 , issued to K. Yokosuka in 1985. Yokosuka's clasp functions in a manner more similar to that of the present invention than does any other clasp found in the patent literature during a search of Class/-Subclass 24/265EC and 24/265WS. Still, Yokosuka's clasp includes an upper cover that is "provided with a protruding member dimensioned and positioned to be pressed into . . . " a cavity in the latch mechanism. Such a pressed fit depends upon the compressive elasticity of the snug fitting parts and subjects those parts to wear or permanent deformation, eventually resulting in failure of the clasp or, in this case, failure of the upper cover to remain closed.

DETAILED DESCRIPTION OF THE INVENTION

In this description of the invention, reference will be made to the figures described above, wherein like reference numbers have been assigned to like pieces in all of the figures.

Figure 1:
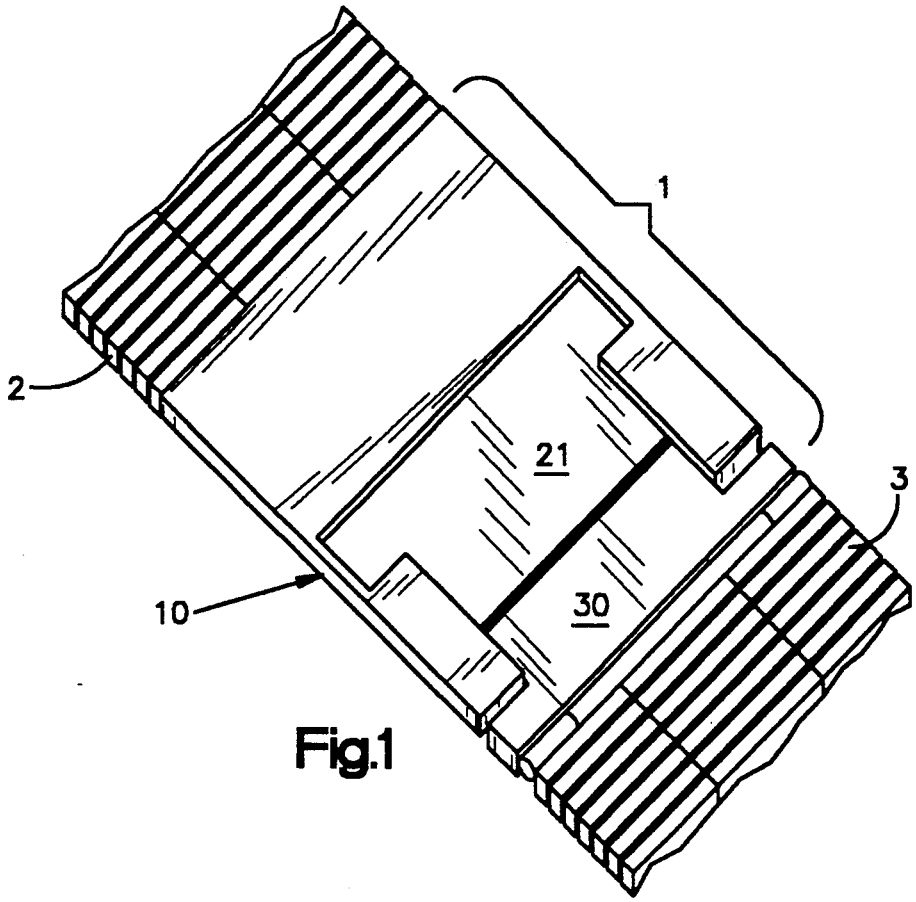
FIG. 1 presents a perspective view of the invention in the engaged or clasped position as it would be worn on the person.

FIG. 1 shows the clasp of this invention in perspective view to show the exceptionally clean and uncluttered appearance of the clasp 1 in its preferred embodiment. The clasp, principally designed for use in connecting two free ends of bands attacted to wrist watches, connects a first band end 2 with a second band end 3. In the preferred mode, all exposed surfaces shown in FIG. 1 have an attractive finish, being a precious metal or a precious metal alloy or coating; this is only for the sake of appearance, which is important in this field of art, but is not essential to the function of the clasp. The clasp would function as well were it made of inexpensive materials, even polymers or plastics.

Figure 2:
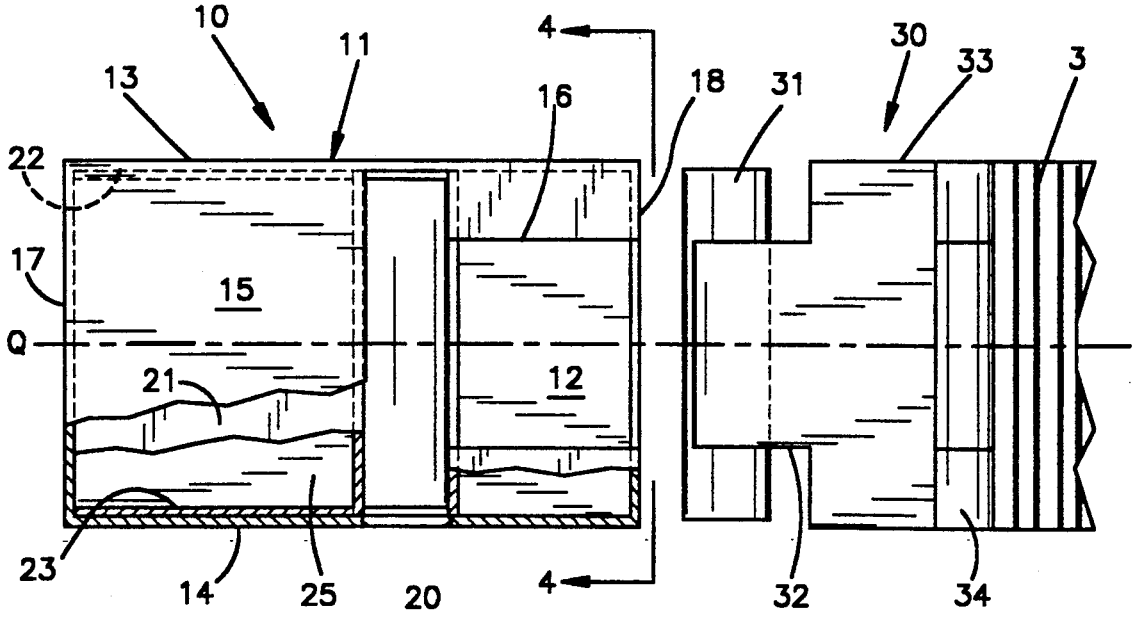
FIG. 2 presents a partial cutaway plan view of the clasp elements disengaged from one another.
Figure 3:
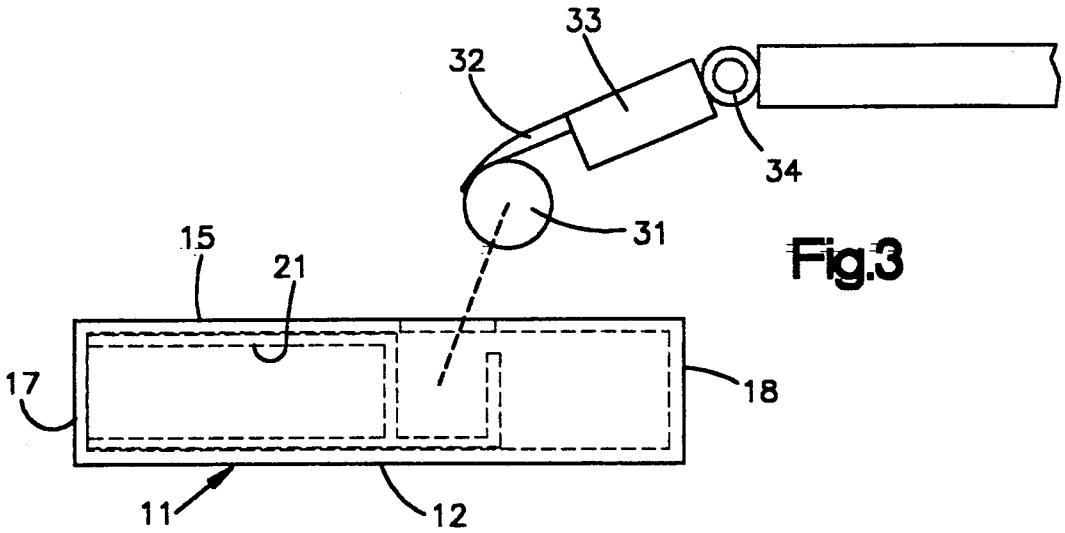
FIG. 3 presents a side view of the clasp elements disengaged from one another.
Figure 4:
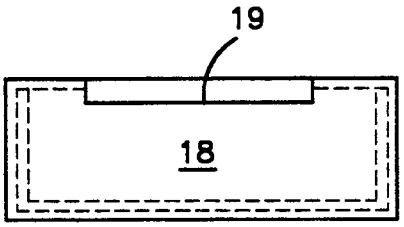
FIG. 4 presents an end view of the box portion of the clasp elements.
Figure 5:
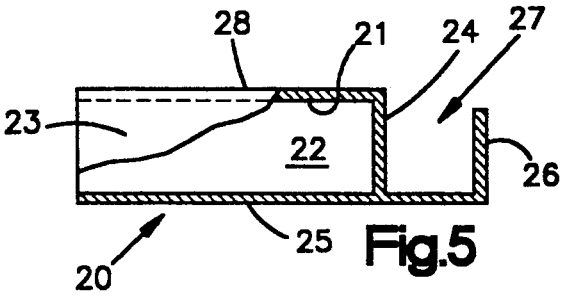
FIG. 5 presents a side view of the inner slide element of the clasp.
Figure 6:
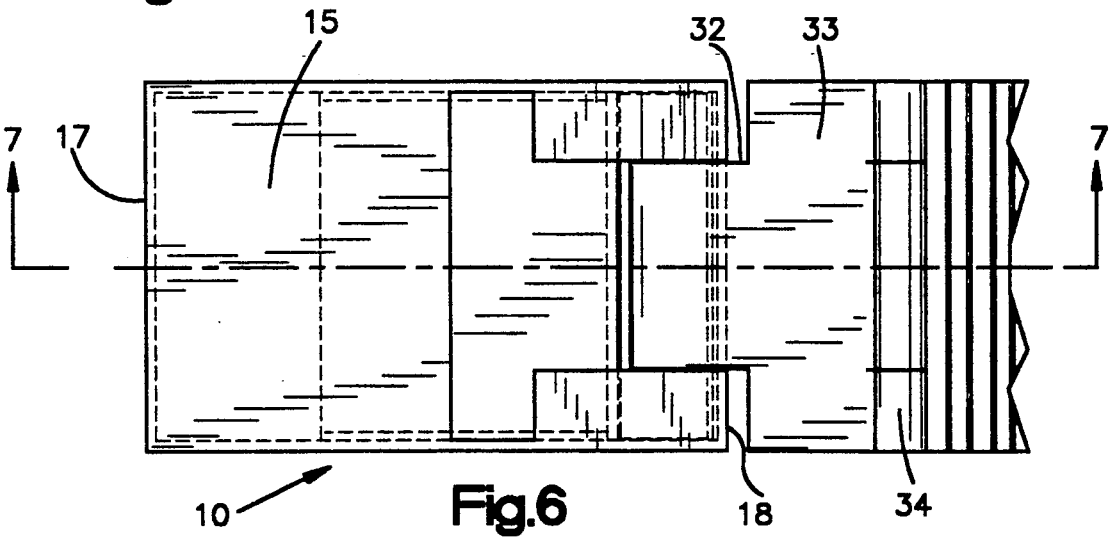
FIG. 6 presents a plan view of the clasp elements in the engaged or clasped position.

The working parts of the invention are more readily seen in the figures subsequent to FIG. 1. The disengaged clasp elements are presented in plan view in FIG. 2 and in side view in FIG. 3. In these figures, it can be seen that the clasp includes a box element 10 that comprises an outer box 11 having a bottom wall 12, two side walls 13 and 14, a top wall 15 having a "T"-shaped cutout 16 therein, a first end wall 17 that is adapted to be attached to a first band end 2, and a second end wall 18 having a cutout 19 contiguous with said "T"-shaped cutout, most easily seen in FIG. 4. Slidably contained within this outer box 11, there is an inner box or slide 20. The slide 20, shown separately in FIG. 5, comprises a slide top wall 21, two slide side walls 22 and 23, a slide end wall 24, and a slide bottom wall 25 that has a portion 26 that extends beyond the slide end wall 24 and then upward to form a receiving well 27.

The clasp also includes a bar element 30 that comprises a bar 31 approximately sized to fit within the receiving well 27 within the outer box 11; the bar 31 is attached to a tab extension 32 from a band-end body 33 that is adapted to be attached, preferably by means of a hinge 34, to the second band end 3. The tab extension 32 is sized to fit into cutout 19 in the second end wall 18 of the outer box 11 when the clasp 1 is fully engaged.

Figure 7:
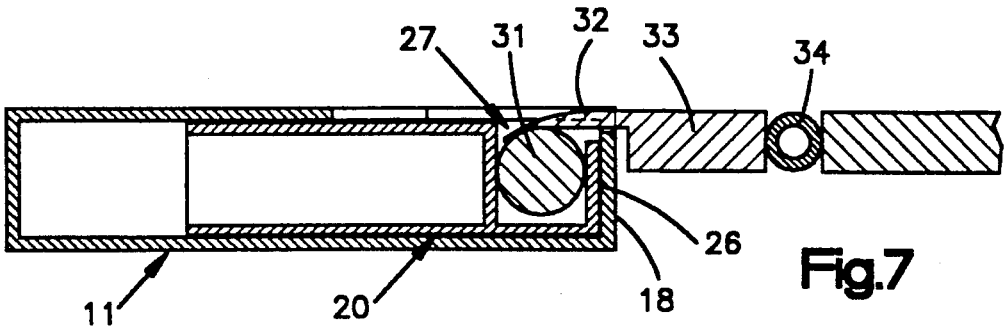
FIG. 7 presents a cross sectional view indicated by the line 7—7 in FIG. 6.

The operation of the clasp is quite simple. To open the clasp from the closed position, as shown in FIG. 7, the second band end 3 is lifted, causing pivotal rotation of the tab extension 32 and the bar 31 while the latter is confined by the well 27 and the outer box portions defining the stem of the "T" in the "T"-shaped cutout 16. This motion disengages the tab extension 32 from the end-wall cutout 19 and creates clearance for the band-end body 33 to pass above the outer box 11 in a direction wherein the bar 31 and the well 27 in which it is confined are moved toward the wide portion of the "T"-shaped cutout 16 in the outer box 11. When the bar reaches this wides portion, further lifting of the second band end 3 lifts the bar from the well and the clasp is open so the band ends may be separated.

In closing the clasp, the process is reversed: the bar 31 is inserted into the well 27 through the "T"-shaped cutout 16 and then is moved toward the first end wall 17, moving with it the slide 20, the finished top surface thereof 28 thereby being exposed through the opening of the cutout 16 to attractively fill the opening for a smooth and clean external appearance. When the slide 20 reaches the second end wall 18, the second band end 3 may be lowered, thereby causing pivoting of the tab extension 32 and the bar 31 to a position wherein the band-end body 33 is in the latched position wherein it prevents motion of the bar 31 that would be sufficient to effect release of the bar 31 from the outer box 11.

It is clear that variations may be made on several parts of the latch as herein described. The slide 20 may be made more simply as merely a single piece of flat metal bent to form a well 27 and a slide top wall 21. Such a slide could also have its edges bent down to form slide side walls 22 and 23 and substantially without a bottom wall 25. A slide made this way may be less expensive to manufacture and may suffice, as the important parts on the slide are the well and the top surface.

Another variation might be a provision for the top surface of the slide to be caused to move upward into the "T"-shaped cutout when the clasp is closed, thereby to create a still more smooth external appearance.

Having described his invention, including a totally functional specific example thereof, applicant desires to include within the scope of his invention those improvements that would be immediately obvious to one skilled in the art, some, but not all of which improvements have been referred to herein. Applicant desires the breadth of his invention to be limited only by the scope of the claims appended hereto.

I claim:

1. A closure for connecting a first and a second free end of a band as might be used as a strap on a wrist watch, said closure comprising:

a box element adapted for attachment to said first band end, said box element comprising an outer box having a bottom wall, two side walls, an end wall distal said first band end, and a top wall having a first cutout creating an opening therein, the width of said first cutout varies along the length thereof to provide a wide portion thereof proximal said first band end and a narrow portion thereof distal said first band end, said top wall having a top surface, said box element further comprising a slide element slidably contained within said outer box, said slide element comprising a slide top wall and a receiving well, said slide top wall having a top surface; and a bar element adapted for attachment to said second band end, said bar element comprising a bar appropriately sized to engage and fit into said receiving well within said outer box by passing through said wide portion of said first cutout therein and to be slidably retained by said outer box after said bar is moved in a direction away from said first band end to a retained position wherein said bar is retained by slidable contact with those portions of said top wall adjacent to and delimiting said cutout at said narrow portion thereof, said bar element further comprising a tab extension connecting said bar to a band-end body adapted for attachment to said second band end, said tab extension having a top surface;

wherein said moving of said bar to said retained position causes, by means of the engagement of said bar with said receiving well, movement of said slide element in the same direction, thereby to expose a portion of said slide top wall through said first cutout to present a clean and finished appearance of the closure when so closed, and wherein a pivoting motion of said bar element about said bar moves said band-end body portion of said bar element into a position wherein said band-end body prevents translational motion of said bar element that would be sufficient to effect the release of said bar from said outer box, by securement of said box element end wall between said bar and said band-end body, the closure then securely holds said free ends together.

2. The closure of claim 1 wherein said first cutout is in the shape of a "T".

3. The closure of claim 1 wherein said slide further comprises two slide side walls.

4. The closure of claim 1 wherein said slide further comprises a slide bottom wall.

5. The closure of claim 1 wherein said end wall of the outer box has therein a second cutout contiguous with said first cutout, said second cutout being dimensioned to receive therein said tab extension, thereby to allow said top surface of said tab extension to be flush said top surface of said top wall of said outer box.

6. The closure of claim 1 wherein said bar element is hingedly attached to said second band end.

* * * * *